United States Patent [19]

Bubley

[11] Patent Number: 4,879,948

[45] Date of Patent: Nov. 14, 1989

[54] PRESS WITH AUTOMATIC SHEET TRANSPORT MECHANISM

[75] Inventor: Henry J. Bubley, Deerfield, Ill.

[73] Assignee: American Screen Printing Equipment Company, Chicago, Ill.

[21] Appl. No.: 253,121

[22] Filed: Oct. 4, 1988

[51] Int. Cl.[4] ..... B41F 15/00

[52] U.S. Cl. ..... 101/114; 271/85; 271/268; 101/126

[58] Field of Search ..... 101/114, 115, 124–126, 101/408, 232; 271/84, 268, 194

[56] References Cited

U.S. PATENT DOCUMENTS

| | | | |
|---|---|---|---|
| 1,336,598 | 4/1920 | Throop | 271/85 |
| 1,940,154 | 12/1933 | Sylva | 271/85 |
| 2,814,987 | 12/1957 | Foard | 101/115 |
| 2,893,732 | 7/1959 | Hauck | 271/268 |
| 4,031,824 | 6/1977 | Bubley et al. | 101/126 |
| 4,512,563 | 4/1985 | Bubley | 101/232 X |
| 4,526,100 | 7/1985 | Brasa | 271/85 |
| 4,589,335 | 4/1986 | Svantesson | 101/114 |
| 4,641,829 | 2/1987 | Kolblin | 271/268 |
| 4,664,577 | 4/1987 | Bonali | 271/85 |
| 4,802,410 | 2/1989 | Ericsson | 101/124 |

*Primary Examiner*—E. H. Eickholt

*Attorney, Agent, or Firm*—Fitch, Even, Tabin & Flannery

[57] ABSTRACT

A printing press having novel sheet transport mechanisms which facilitate precise operation at high speeds. In the preferred embodiment, the press includes a printing bed which pivots forward and downward on parallel links to remove sheets of stock from forwardly opening grippers. Also in the preferred embodiment, novel mechanisms for opening and closing the grippers are provided, including a mechanism for closing the grippers which is inoperable until the grippers are in the proper position to grip the leading edge of a sheet of stock.

12 Claims, 6 Drawing Sheets

FIG. 8
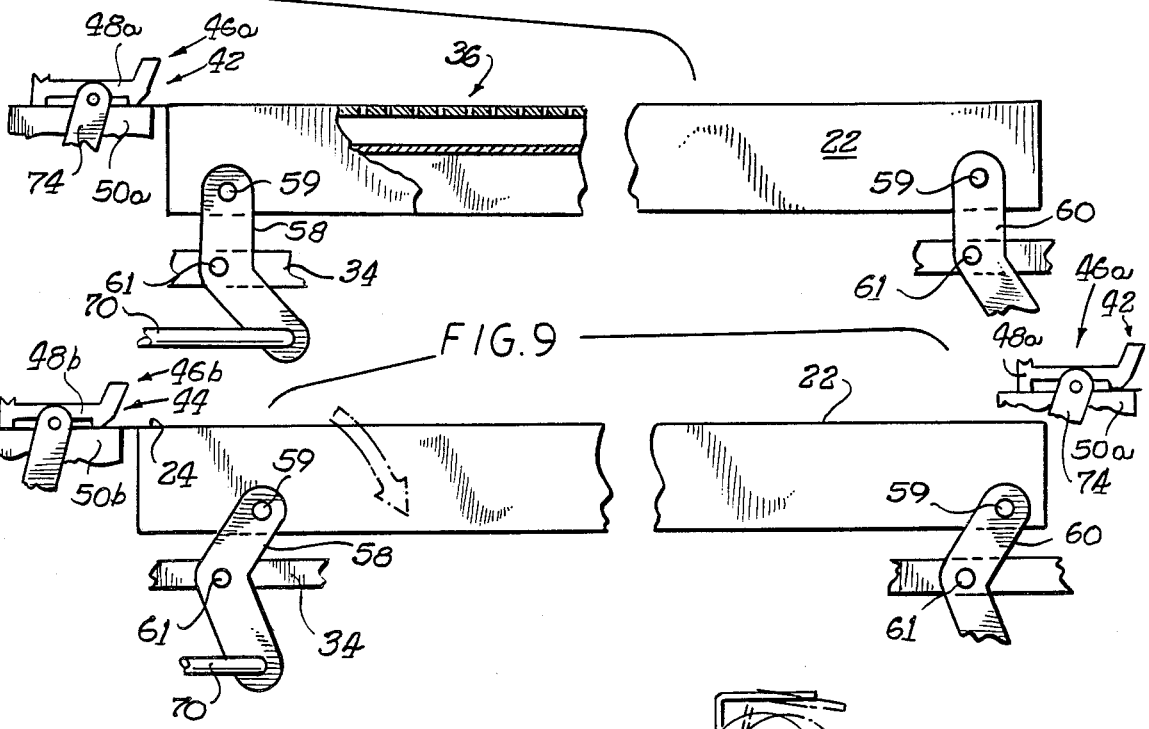
FIG. 9
FIG. 10
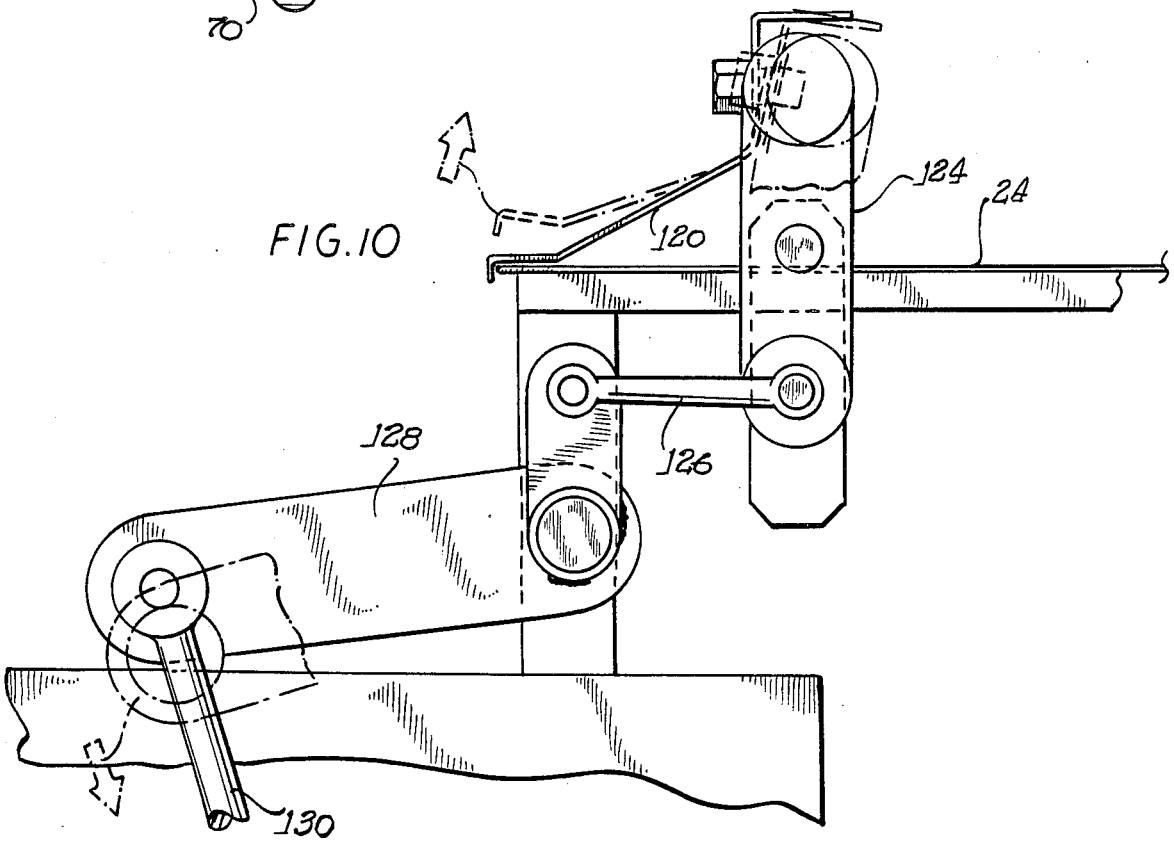

PRESS WITH AUTOMATIC SHEET TRANSPORT MECHANISM

BACKGROUND OF THE INVENTION

The invention relates to printing presses, and more particularly to a press having means for automated handling of sheet stock.

Transporting sheet stock in a sheet-fed press typically involves two steps: feeding, i.e., transporting sheets from an input station to a printing bed; and takeoff, i.e., removing printed sheets from the bed. One or both of these steps may be performed automatically.

In addressing the problem of handling sheet stock, a principal consideration is that apparatus for performing these functions must be capable of consistent precision and accuracy. A single misfeed may cause a series of subsequent misfed sheets and prevent any sheets from printing properly until the misfed sheets are removed.

Another concern is providing apparatus that is capable of high-speed operation. Mechanical efficiency tends to facilitate high-speed operation, and, accordingly, it is generally desirable that sheet-handling apparatus have no unnecessary moving parts, and no unnecessary movements.

Economy of manufacture and reliability are, of course, also essential to commercially viable equipment. These interests are also served by mechanical simplicity and efficiency.

One problem addressed by the present invention relates to automated closing of grippers on the edge of a sheet of stock. A mechanism for performing this function generally requires a relatively high degree of precision. If the grippers are closed too early, a variety of undesirable results may occur. The grippers may close before engaging the edge of the sheet of stock at all, or close on the sheet before their forward movement is complete, then push the sheet in the wrong direction for a short distance before beginning travel in the proper direction. Another possibility is that the grippers may obtain a partial grip on the stock, leading to dropping of the sheet during travel toward the printing bed, tearing of the stock, or improper registration of the sheet on the printing bed. Similar undesirable effects may result from late closing of the grippers.

Printing presses having automatic gripper assemblies for transporting sheets of stock generally employ unduly complex mechanisms to transport the grippers and open and close the grippers at desired points. These mechanisms may require excessive attention during set-up and adjustment to ensure proper operation. The present invention addresses this problem.

A second problem addressed by the invention relates to displacement of the printing bed to avoid interference between the bed and the grippers. The problem arises in presses which employ grippers that are disposed at such an elevation that their lower jaws are at least partially below the level of the printing bed in its printing position. The grippers move in a cycle, starting on one side of the printing bed and traveling rearward to pull a sheet over the bed, then opening to release the sheet and returning back over the bed to pick up the next sheet.

To avoid interference between the grippers and the printing bed, some presses in the past have employed means to lower the printing bed in rectilinear vertical travel from its upper, printing position to a lower position to permit the grippers to pass over the printing bed without interference. Typically, such mechanisms require that, after the grippers have opened to release the sheet and deposit it on the printing bed, the grippers move rearwardly, or else have their lower jaws retracted, to enable the sheet to drop vertically downward with the bed, without interference between the edge of the sheet and the lower jaws of the gripper during the downward travel of the sheet. After the sheet has dropped, the grippers may then travel forward, returning over the printing bed, to pick up the next sheet.

The output rate of presses operating as described above is limited by the complexity of the motion of the grippers. There remains a need for more efficient means to avoid interference between the grippers and the printing bed.

Accordingly, it is a general object of the invention to provide a press having improved sheet-handling mechanisms.

It is a further object to provide a press having improved means for controlling gripper opening and closing.

It is an additional object of the invention to provide a press having improved means to avoid interference between the grippers and the printing bed.

Further objects of the invention will become apparent from the description set forth below and the accompanying drawings.

SUMMARY OF THE INVENTION

The invention provides a press with simple, efficient sheet transport mechanisms which facilitate precise operation at high speeds.

In accordance with one aspect of the invention, means are provided to move the printing bed between an upper position for printing and a lower position to provide clearance for gripper travel, wherein the lower position is located forwardly of the upper position. Once the grippers open to deposit a sheet of stock on the bed, the bed moves forward and downward, pulling the sheet of stock forward to remove it from the grippers before or during its downward travel, thus eliminating any need for rearward movement of the grippers after the grippers open. The bed preferably remains horizontal as it travels forward and downward, and to this end, is preferably supported on a plurality of parallel, pivotal links. The links are preferably disposed vertically when the bed is in its upper position so that the initial forward movement of the bed is substantially horizontal.

In accordance with a second aspect of the invention, closing of the forward grippers at the infeed station is controlled by a novel mechanism which ensures precise operation and proper timing of gripper closure. The possibility of premature closure of the grippers is eliminated by providing that the mechanism becomes operable only after the grippers have reached the proper position for gripping the leading edge of the sheet.

The grippers are biased toward their closed position and ride on a carriage which has its forwardmost position defined by a stop. The stop is positioned so that the grippers are properly positioned to grip the leading edge of a sheet of stock when the carriage reaches the stop.

The gripper jaws are opened as the carriage approaches the stop by engagement between a cam follower connected to the grippers and a ramp mounted on the press frame. The ramp is positioned such that the carriage reaches its stop before the cam follower reaches the end of the ramp. Thus, the forward travel of the cam follower is halted before the cam follower reaches the end point of the ramp. This precludes premature closing of the grippers.

To enable the grippers to close after the carriage reaches the stop, the ramp is moved rearwardly after the carriage reaches the forward stop to pull the forward end of the ramp rearward past the cam follower. The rearward displacement of the ramp may be effected by employing a resiliently extendable rod to drive the carriage, and providing a dog on the drive rod which continues to travel forward after the carriage itself has stopped, and which: engages a lever to pull the ramp rearward after the carriage has reached the forward stop.

BRIEF DESCRIPTION OF THE DRAWINGS

FIG. 8 is a schematic side elevation view illustrating the printing bed in its upper position.

FIG. 9 is a schematic side elevational view illustrating the printing bed in its lower position.

FIG. 10 is a schematic fragmentary side elevational view illustrating a removable stop mechanism used in the transport mechanism.

DETAILED DESCRIPTION OF PREFERRED EMBODIMENTS

Figure 1:
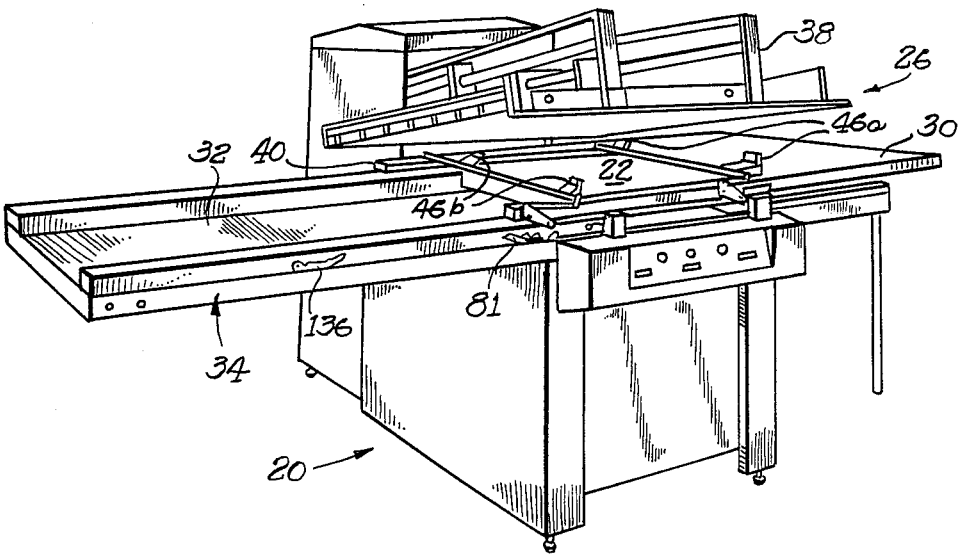
FIG. 1 is a perspective view of a press having a printing bed and sheet transport apparatus in accordance with the invention.
Figure 6A:
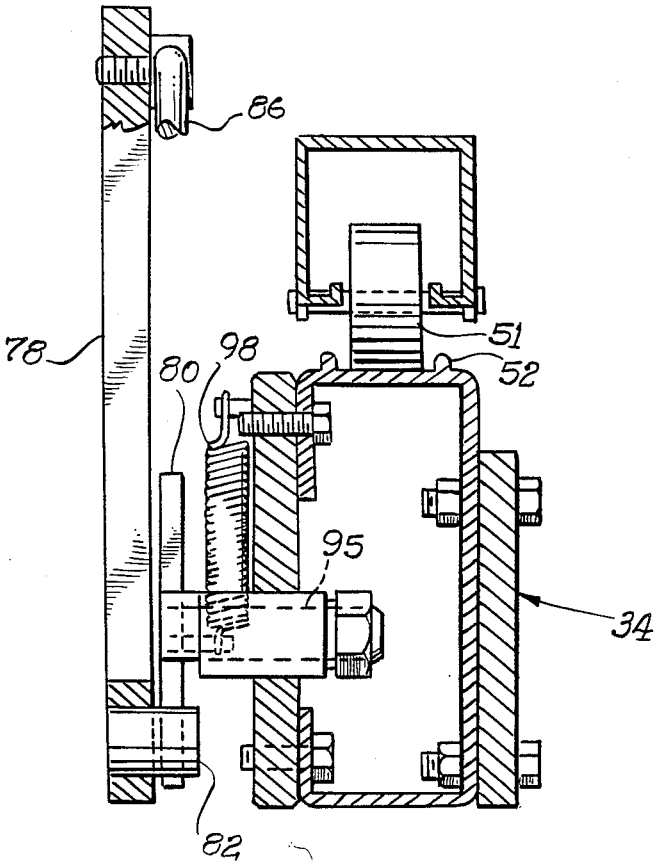
FIG. 6A is a sectional view taken substantially along line 6A—6A in FIG. 6.

The invention is generally embodied in a printing press 20 which comprises a bed 22 for supporting a sheet of stock 24 during printing, a movable print head 26 disposed above the bed 22 having means thereon for applying printed material to the stock, and transport means, indicated generally at 28, for automatically moving stock from an input station 30 at the forward end of the press rearward to the printing bed 22 and thence rearward to a delivery station 32. The printing bed, head, and transport means are supported on a common frame 34.

The bed 22 has vacuum means 36 (FIG. 8) to hold the stock 24 in place on the bed 22 during printing. The print head 26 is pivoted at one side and is movable between an upper position, shown in FIG. 1, and a lower position for printing. The head comprises a frame 38 which supports a screen and a squeegee assembly of conventional design. During printing, the screen is suspended a short distance above the sheet of stock, and the squeegee passes over the screen, deflecting the screen downward into contact with the stock and forcing ink through the screen into the stock. Means are provided to raise and lower the head, and drive the squeegee mechanism, in timed relation to the transport means 28 for automatic operation.

The transport means 28 in the preferred embodiment comprises a gripper carriage 40 having a forward gripper assembly 42 and a rear gripper assembly 44 supported thereon. The forward gripper assembly 42 functions to transfer stock from the input station 30 to the printing bed 32. The rear gripper assembly 44 functions to remove stock from the printing bed after printing and transfer it rearward to the delivery station 32.

Each gripper assembly comprises a plurality of grippers **46*a*, 46*b* disposed in alignment for operation in unison. Each gripper has an upper jaw 48*a*, 48*b* and a lower jaw 50*a*, 50*b***.

The illustrated gripper carriage 40 rides on wheels 51 on a track 52 which extends between the forward and rear ends of the press frame 34. A stop 53 is provided at least at the forward end of the track 52 to provide a precise stopping point for forward travel of the gripper carriage 40. The gripper carriage 40 is driven in its reciprocating rectilinear motion by a reciprocating carriage drive arm 54 which is pivotally connected to the carriage by a connecting rod 56.

PRINTING BED TRAVEL

The forward grippers **46*a* are disposed at about the same elevation as the upper surface of the printing bed 22. This requires that the printing bed 22 be lowered each time the forward grippers 46*a*** cross it.

In the past, the problem of lowering the printing bed for this purpose has been addressed by providing means to move the printing bed in rectilinear vertical travel between an upper position and a lower position. After the forward grippers open to release the sheet, the forward grippers are moved slightly rearward, or else the lower jaws retracted, to provide clearance for the proximal edge of the sheet to move downward with the printing bed.

In accordance with one aspect of the present invention, the requirement for rearward movement of the forward grippers **46*a* is eliminated by the provision of means to carry the printing bed 22 forward from the forward grippers 46*a* so that the sheet of stock is removed from the open jaws 48*a*, 50*a* of the forward grippers by the printing bed 22. To this end, the printing bed 22 in the illustrated embodiment is supported on a plurality of parallel links which pivot in synchronized movement to raise and lower the bed 22. In the preferred embodiment, the bed 22 is supported by a first pair of links 58 disposed near the rear corners of the bed 22, and a second pair of links 60 disposed near the forward corners of the bed. Each of the links has an upper pin 59 pivotally connecting it to the bed and a lower pin 61 pivotally supporting it on the press frame 34. The operative lengths of the links 58, 60, i.e., the distances between the centers of the pins 59 and 61 on each link, are preferably equal to one another to provide a parallelogram-like configuration of the bed 22 and links 58, 60, with the result that the bed 22** remains horizontal at all times.

The bed moves upward and rearward as the sheet 24 to be printed is moved rearward to the printing position by the forward grippe assembly 42a. In the preferred embodiment, the motions of the printing bed 22 and grippers 46a, 46b are timed so that so that the movement of the bed relative to the sheet is substantially entirely vertical as the sheet and bed approach the printing positions. This avoids wrinkling or rattling of sheets of stock as the bed reaches its upper position and comes into contact with the stock.

The preferred means for driving the printing bed comprises a captive or box cam 62 and a linkage 64 between the camming surface and at least one of the links which support the bed. The illustrated linkage comprises a first link 66 having a cam follower 68 at its lower end and a pivotal connection to a second link 70 at its upper end. The first link 66 is pivoted about a bracket 72 on the press frame 34. The second link 70 extends substantially horizontally and is axially reciprocable to raise and lower the bed 22. The cam 62 rotates continuously to reciprocate the bed between its upper and lower positions, and its rotation is timed with the operation of the carriage drive which is described in detail below.

GRIPPER OPERATION

The gripper assemblies 42, 44 are substantially identical in construction. Referring for convenience to the forward gripper assembly 42, opening and closing of the grippers is preferably effected by pivoting the upper jaws 48a, with the lower jaws 50a remaining horizontal. A control lever 74 extends downwardly and rearwardly on one side of the gripper assembly 42. The control lever is fixedly attached to a camshaft 75 which extends the width of the gripper assembly 42 between the jaws, and has cams 77 thereon to open the grippers when the shaft 75 is rotated counterclockwise. Thus, when the lower end of the control lever 74 is pushed forward, the upper jaws 48a are raised to open the grippers. A biasing means such as a coil spring 76 loaded in tension and extending between the upper and lower jaws exerts downward force on the upper jaws continuously to bias them toward the lower or closed position. A detailed description of a similar mechanism is set forth in U.S. Pat. No. 4,512,563, which is incorporated herein by reference.

The forward grippers 46a pick up a sheet of stock at the input location 30, while the rear grippers 46b simultaneously pick up a sheet of printed stock from the printing bed 22 for removal to the delivery station 32. The opening and closing of the respective grippers at these locations is controlled by similar mechanisms.

Each of the illustrated gripper assemblies 42, 44 has a triangular lever or bell crank 78, 79 associated therewith which cooperates with a ramp or trigger 80, 81 on the press frame 34. Referring specifically to the forward gripper assembly 42, the bell crank 78 has a roller 82 which functions as a cam follower disposed at its lower forward end. At its lower rear corner, the bell crank 78 is attached to the carriage by a pin 84 about which it pivots. At its upper corner, the bell crank is pivotally attached to a connecting rod 86 which extends to the lower end of the gripper lever 74. When the cam follower-roller 82 on the bell crank 78 is pushed downward, the bell crank 78 rotates in a clockwise direction, pushing the connecting rod 86 forward to open the associated grippers 46a.

The ramps 80 and 81 are attached to the press frame 34. Referring specifically to the forward triangular bell crank 78 and its associated ramp, the operative surface 88 of the ramp 80 faces downwardly, and comprises a rear portion 90 which slopes downward and forward and a front portion 92 which slopes upward and forward. When the roller 82 engages the ramp 80, it is traveling forward and is displaced downward as it rolls along the rear portion of the ramp surface 88. The ramp 80 is located so that the grippers 46a will fully open as they come into position to engage the leading, or rear, edge of the sheet which they are to grip. The ramp's location is related to that of the stop so that when the stop 53 halts the forward travel of the gripper carriage 40, the cam follower 82 is near or at its lowermost point on the ramp 80, and the jaws 48a and 50a are fully open, with the upper jaws 48a being located above the leading edge of the sheet to be gripped, and the lower jaws 50a being disposed therebeneath.

The ramp 80 is pivoted on a support plate 94 so as to be pivotable between an upper position for operation as described above, and a lower position in which the roller 82 may roll rearwardly over the top of the ramp during rearward travel of the gripper carriage. The ramp pivots about a pin 95 at its forward end. The ramp is pivoted downward by the roller 82 during rearward travel of the gripper carriage. A stop 96 is provided on the support plate to limit upward travel of the ramp 81, and in the illustrated embodiment, a coil spring 98 loaded in tension holds the ramp 80 against the stop.

In accordance with a feature of the invention, when the carriage reaches the forward stop 53, the ramp 80 is moved rearward to permit the cam follower 82 to travel upwardly, thus permitting the grippers 46a to close. In the preferred embodiment, the rearward movement of the support plate is accomplished by engagement between an actuating member or dog 100 on the connecting rod 56 and a lever 102 connected to the support plate 94.

The forward travel of the carriage 40 is effected by the above-described carriage drive arm 54. The carriage drive arm 54 pivots forward to pull the carriage 40 toward its forward position, and continues to move forward for a short distance after the carriage 40 reaches its forward position and is brought to a halt by the stop 53. This is made possible by the connecting rod 56 being resiliently extendable.

Preferably, the connecting rod 56 comprises a pair of telescoping members 101a and 101b and a tension spring 103 which biases the rod against elongation. The spring preferably has sufficient tension that the rod 56 does not elongate except after the carriage reaches the full stop. After the carriage reaches the stop, the forward portion 101a of the rod 56 continues to travel forward for a short distance with the drive arm 54, while the spring tension maintains the carriage in abutting relation with the stop 53.

The dog 100 is mounted on the forward portion of the connecting rod 56 to engage the lever 102. The lever 102 is pivoted on the press frame 34. The dog 100 pushes the outer portion of the lever 102 forward, which drives the inner end of the lever rearward, pulling the plate 94 rearward.

The plate 94 is mounted on the press frame 34 by four bolts or pins 104. Each of the pins passes through a horizontally-elongated opening 106 in the plate 94 which permits horizontal displacement of the plate. The plate is biased toward its forward position.

The lever 102, when actuated as described above, thus pulls the plate rearward sufficiently to allow the cam follower 82 to travel upward, permitting the grippers 56a to close. The upward travel of the cam follower 82 is controlled by the front portion 92 of the ramp surface 88. A bolt 108 connects the inner end of the lever 102 and the plate 94. The bolt 108 preferably has a compression spring mounted thereon, acting between a bracket 112 in the press frame and a nut 114 on the bolt 108 to bias the plate 94 forward.

The opening of the forward gripper 46a to release the stock on the printing bed is effected by a camming deflection of a ball bearing 116 or the like on the triangular bell crank 78 by a dog or cam 118 on the print head 26. As the print head is raised following printing, the dog 118 contacts the ball 116, deflecting it forward to open the grippers 46a.

MOVABLE STOP

The positions of the sheets at the input station 30 are determined by a temporary stop 120. The stop 120 is movable between a lower position in which it engages the leading edges of the sheets (shown in solid lines in FIG. 10) and an upper position (shown in phantom in FIG. 10) in which is permits sheets to travel freely under it. The sheets may be delivered automatically or manually to the input station 30. In either case, the movable stop 20 ensures that the edge is properly positioned for engagement by the forward grippers 56a at the input station. The movable stop 120 must be displaced in order for the sheet to be carried rearward to the printing station. To this end, the stop 120 is movably mounted on the press frame 34, and is reciprocated in timed relation to the gripper cycle by a captive cam 122 (FIG. 2) connected to the stop 120 by a suitable linkage.

Figure 2:
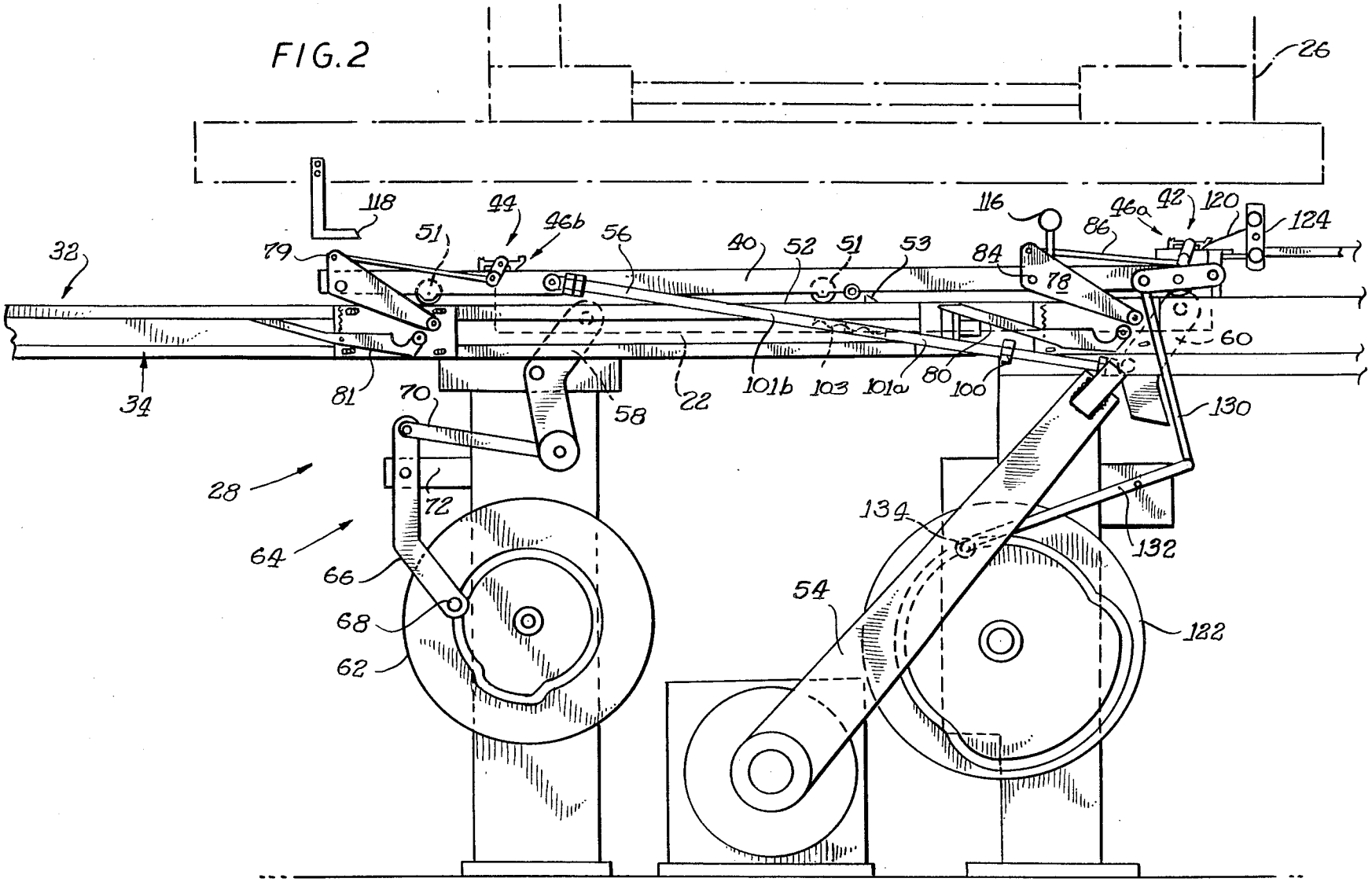
FIG. 2 is a side elevational view showing the sheet transport apparatus of the press of FIG. 1.
Figure 3:
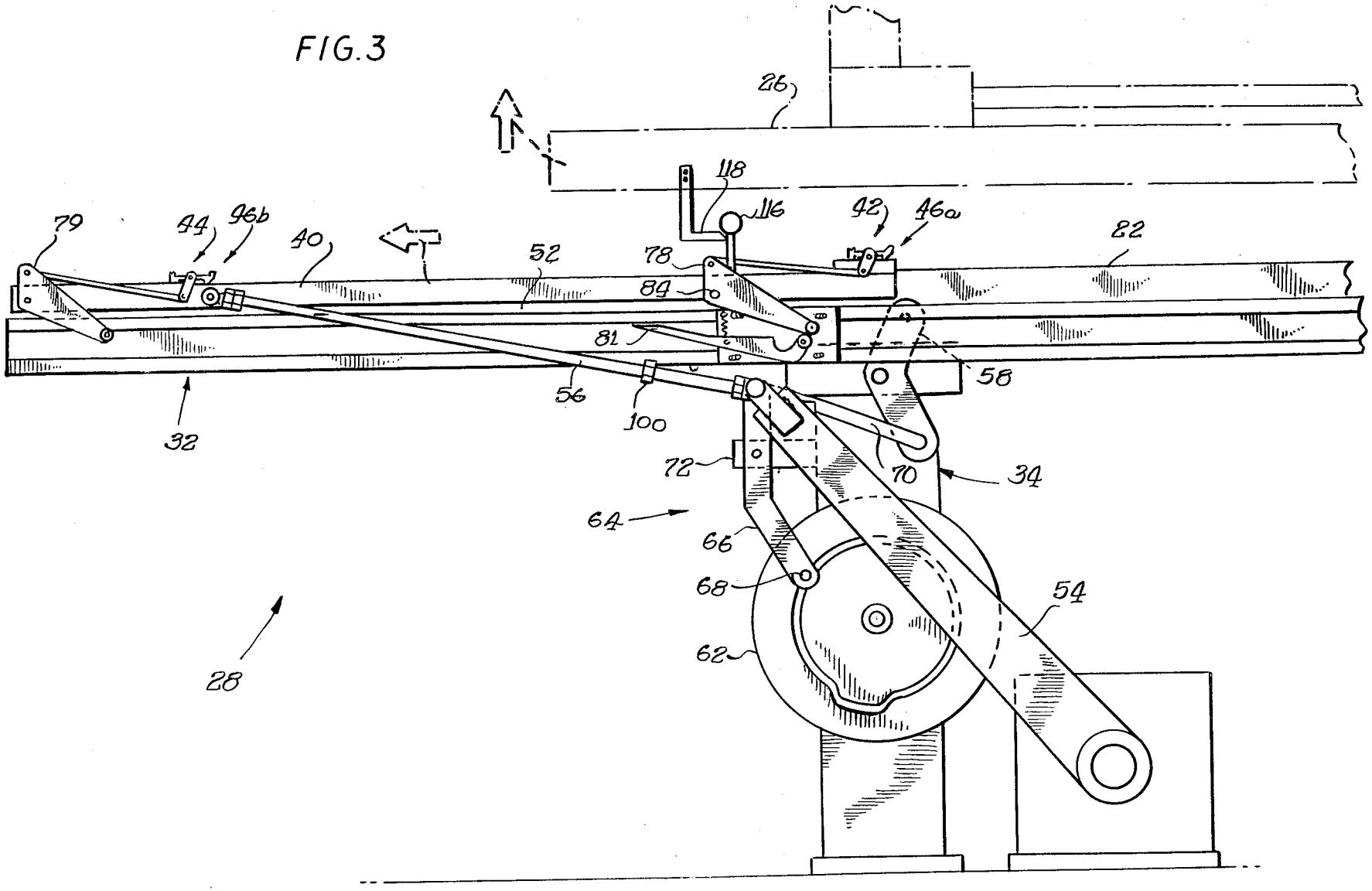
FIG. 3 is a side elevation view of the apparatus of FIG. 2, shown in a position wherein the gripper carriage is displaced to the left as compared with the view in FIG. 2.
Figure 4:
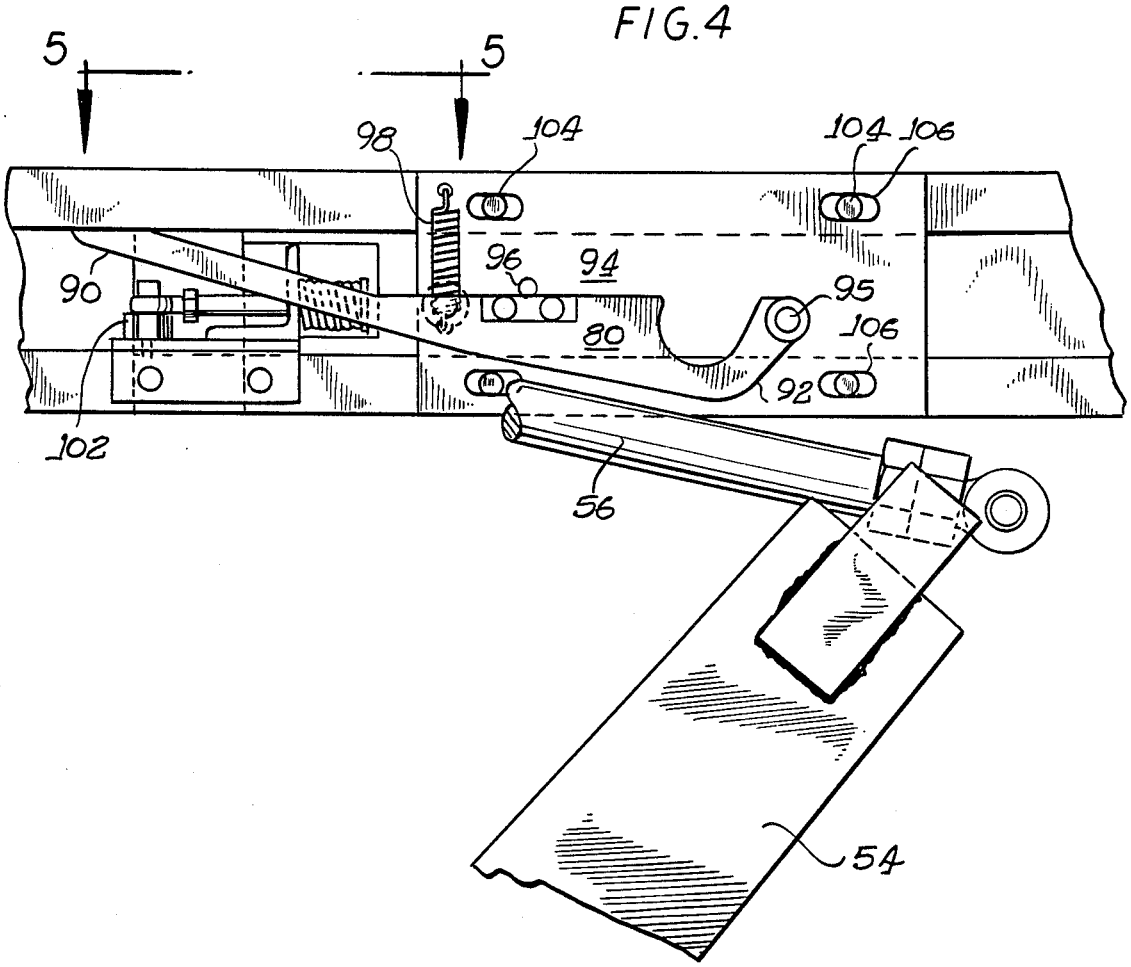
FIG. 4 is a fragmentary side elevational view of a ramp mechanism employed in the sheet transport apparatus.
Figure 5:
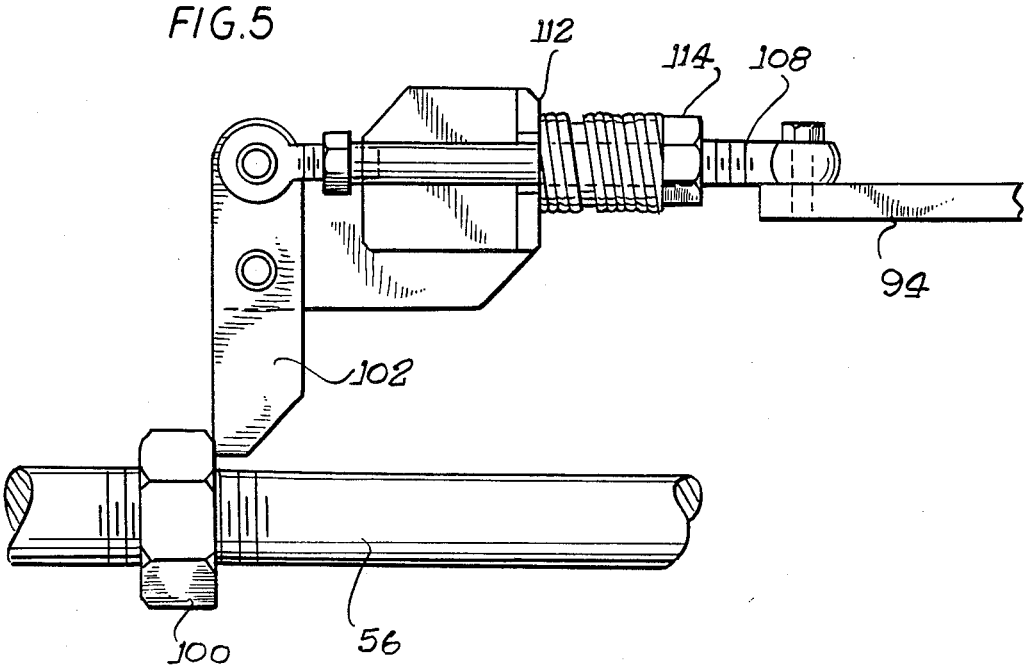
FIG. 5 is a fragmentary plan view taken substantially along line 5—5 in FIG. 4.
Figure 6:
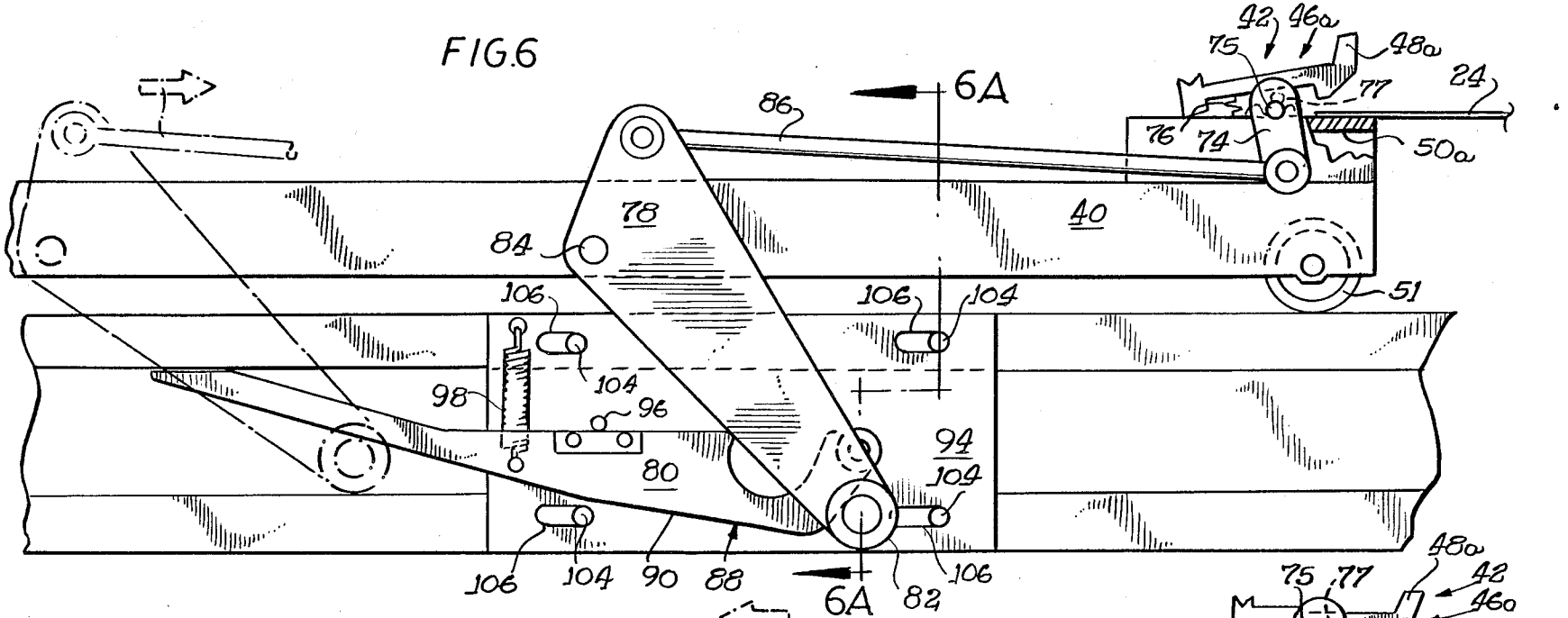
FIG. 6 is a fragmentary side elevational view illustrating a gripper assembly employed in the sheet transport apparatus approaching a closed position.
Figure 7:
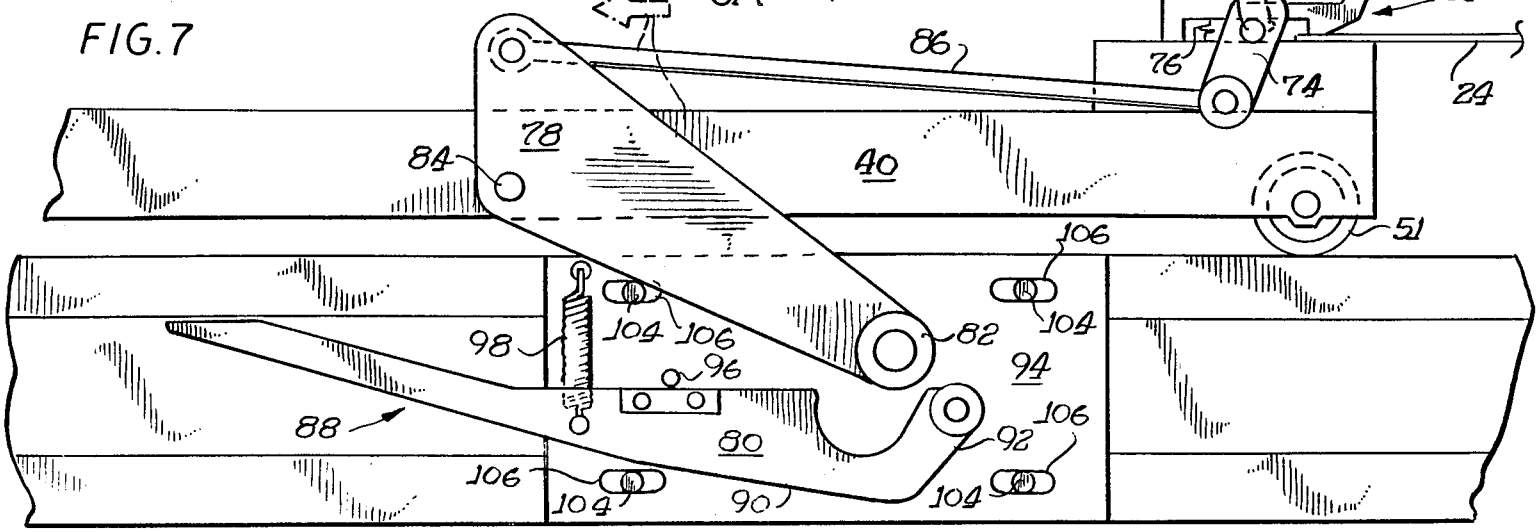
FIG. 7 is a side elevational view showing the forward gripper assembly of FIG. 6 shortly after it has reached its closed position.

As shown in FIG. 10, the movable stop 120 is preferably mounted on a support 124 which is pivoted on the press frame. The support 124 is normally vertical. The lower end of the support is attached by a short link 126 to a bell crank 128 also pivoted on the press frame. A connecting rod 130 attached to the end of the lower member of the bell crank 128 is driven alternately up and down to pivot the support 124 on which the stop is supported, thus raising and lowering the stop 120. As shown in FIG. 2, the rod 130 is connected at its lower end to a pivoting link 132 having a cam follower 134 thereon engaging the captive cam 122.

SUMMARY OF OPERATION

The operation of the press may be described with reference to the progress of a sheet of stock through the press 20.

The sheet of stock 24 is initially positioned for infeed purposes with its leading edge abutting the temporary stop 120 at the forward end of the press. The forward grippers 46a move forward in open position until the respective jaws 48a and 50a of the forward grippers 46a are in position above and below the leading edge of the sheet. The forward grippers 46a then close, the temporary stop 120 is lifted, and the gripper carriage 40 travels rearward. At this point, the printing bed 22 is in its lower position.

As the forward grippers 46a approach their rear position, the printing bed 22 is displaced rearward and upward to support the sheet. When the forward grippers 46a reach their rearmost position, and the printing bed 22 reaches its uppermost position, a vacuum is then applied to the support surface to hold the stock securely on the support surface of the printing bed. The support surface of the printing bed at this point is at substantially the same elevation as the upper surfaces of the lower jaws 50 of the grippers.

The press then undergoes the printing cycle, lowering the print head 26 so that the screen is positioned immediately above the stock, and the squeegee traverses its cycle to print the desired material on the stock. After printing is complete, the head 26 is raised. As the head travels upward, the dog 118 suspended from the head engages the forward gripper assembly to open the forward grippers. The bed 22 then moves forwardly and downwardly removing the sheet 24 from the grippers 56a. The head 26 continues upward, and the dog 118 moves out of engagement with the ball bearing 116, permitting the forward grippers 46a to close. The forward grippers 46a then travel forwardly over the lowered bed 22 to pick up the next sheet.

As the forward grippers travel forward, the rear grippers 46b, supported on the same carriage 40 and fixed with respect the forward grippers, travel forward to pick up the printed sheet. As the rear grippers 46b travel forward, they are in closed position until the bell crank 79 reaches the rearmost point of the rear ramp 81. The cam follower at the lower forward corner of the bell crank 79 engages the bottom of the ramp and is cammed downwardly, rotating the bell crank 79 clockwise and applying opening force to the rear grippers 46b. The cam follower continues down the ramp 79 and the gripper carriage continues forward until the cam follower has reached a point approximately at the lowermost point of the ramp. At about this point, the gripper carriage 40 reaches its stop 53 and the cam follower's forward travel is thus also stopped. The plate which supports the rear ramp 81 is then shifted rearward, and the upwardly-biased cam follower is permitted to snap upwardly, permitting the jaws of the rear grippers 46b to close on the sheet 24.

The printed sheet is then carried rearward from the printing bed 22 to the delivery station 32 by the rear grippers 46b. As the sheet approaches the delivery station 32, the sheet is released, with the rear grippers being opened by a engagement of the cam follower on bell crank 79 by a ramp 136 which is a mirror image of the ramp 80 described in detail above.

Conclusion

From the foregoing, it should be appreciated that the invention provides a press which employs novel and improved mechanisms to improve efficiency of sheet transport. The invention is not limited to the embodiments described above, or to any particular embodiments, but rather is defined in accordance with the following claims.

What is claimed is:

1. A printing press for use in printing on sheet stock comprising:

a frame;

a printing bed supported on said frame for supporting a sheet of stock, said printing bed being movable between an upper position for printing and a lower position, said printing bed having means to hold said sheet on said printing bed temporarily;

a print head supported on said frame for printing on said sheet;

means for transporting said sheet from an input station to the printing bed, comprising a gripper carriage and a plurality of forwardly opening grippers supported thereon, each said gripper having an upper jaw and a lower jaw and being movable between an open positon and a closed position;

said means for transporting said sheet further comprising means for translating and operating said grippers in a cycle in which said grippers (a) close upon a leading edge of a sheet of stock at a first position, (b) travel rearward, pulling said sheet to the printing bed, (c) open to release said sheet, then (d) travel forward to return to said first position;

said lower jaw of each gripper being partially at a level lower than the upper surface of the printing bed when the printing bed is in its upper position; and means for moving said printing bed between its upper and lower positions in timed relation with travel of said gripper carriage such that said printing bed travels forward and downward from its upper position to remove said sheet from said grippers without interference between said sheet and said grippers after said grippers open to release said sheet.

2. A printing press in accordance with claim 1 further comprising means for automatically opening and closing said grippers in timed relation with translation of said gripper carriage, comprising:

a mechanism movable between a first position and a second position, and operatively associated with and connected to said grippers such that displacement of said mechanism from said first position to said second position opens said grippers, said grippers being biased toward their closed position;

a stop for limiting forward travel of the gripper carriage;

actuating means disposed on said frame for shifting said mechanism from said first position to said second position as said carriage approaches said stop; and means for displacing said actuating means so as to permit said mechanism to return to said first position after the carriage reaches the stop.

3. A printing press in accordance with claim 1 further comprising means on said print head for engaging said mechanism to open said grippers when said print head is raised.

4. A printing press comprising:

a frame;

a printing bed supported on said frame, said printing bed providing a support surface for a sheet of stock during printing;

a print head for printing on said sheet; and transport means for transporting sheets of stock, comprising:

a carriage movable between a forward and rear position relative to said frame;

a stop supported on said frame to define a limit for forward travel of said carriage;

a gripper assembly supported on said carriage including a plurality of grippers movable between an open position and a closed position;

means biasing said grippers toward the closed position;

an actuating arm connected with said gripper assembly for opening said grippers, said arm being movable between a first position in which said grippers are closed and a second position in which said grippers are open;

a cam follower disposed on said arm;

a ramp supported on said frame to cam said arm from said first position to said second position as said carriage moves forward and approaches said stop, said ramp being operative to maintain said arm in said second position when said carriage engages said stop; and ramp displacement means for displacing said ramp rearwardly after said carriage reaches said stop, thereby disengaging said ramp from said cam follower to allow said grippers to close.

5. A printing press in accordance with claim 4 wherein said printing bed is movable between a first position for printing and a second position disposed lower than said first position and forwardly thereof for permitting said gripper assembly to travel over said printing bed.

6. A printing press in accordance with claim 5 wherein said printing bed is supported on a plurality of links which are oriented vertically when said bed is in said first position, said links having substantially identical operative lengths.

7. A printing press in accordance with claim 6 further comprising means for raising and lowering said bed in timed relation with said gripper carriage such that said bed is moved from its lower to upper position at the same time said carriage approaches its rear position, and said bed arrives at its upper position at substantially the same point that said carriage reaches its rear position, and said bed moves substantially vertically relative to said gripper carriage as said gripper carriage approaches its rear position.

8. A printing press in accordance with claim 7 further comprising means to effect opening of said grippers in response to upward movement of said print head, and means for raising said print head in timed relation to travel of said grippers.

9. A printing press in accordance with claim 8 further comprising a temporary stop movable between a first position in which it holds said sheet of stock in a predetermined location prior to engagement of the stock by the grippers, and a second position in which it permits said stock to be transported by said grippers.

10. In a screen printing press for printing on sheets transported thereto and therefrom, said screen printing press comprising:

a frame;

a screen printing means for printing on a sheet therebelow and mounted on the frame;

a printing bed on the frame movable from an upper printing position to a lowered position;

a gripper means to grip the sheet and to travel in a first direction to move the sheet over the printing bed;

means to open the gripper means after printing and to move the gripper in a reverse direction to grip a new sheet; and means to move the printing bed downwardly and in the reverse direction while the gripper means moves in this reverse direction so that the sheet is traveling also in this reverse direction prior to the bed having completed its downward movement.

11. The screen printing press of claim 10 in which means on the printing bed hold the sheet to the printing bed to remove the sheet from the gripper means when the gripper means are open and the sheet and the printing bed begin their downward and reverse travel to remove the sheet from the gripper means.

12. A printing press comprising:

a frame;

a printing bed supported on said frame, said printing bed providing a support surface for a sheet of stock during printing, said printing bed being movable between an upper position and a lower position located forwardly of said upper position, and having means to hold said sheet on said printing bed temporarily;

a print head for printing on said sheet, said print head being movable between an upper position and a lower position;

an input station on said frame for supporting sheets of stock prior to printing;

a delivery station supported on said frame for receiving sheets of stock after printing; and a movable stop for positioning sheets at said input station; and movable transport means supported on said frame for transporting sheets of stock, comprising:

a carriage movable between a forward position and a rear position relative to said frame;

a track on said frame for supporting said carriage and guiding it;

a stop supported on said frame to define a limit for forward travel of said carriage;

a forward gripper assembly supported on said carriage including a plurality of forward grippers movable between an open position and a closed position;

a rear gripper assembly also supported on said carriage including a plurality of rear grippers movable between an open position and a closed position;

gripper control means associated with each of said grippers for opening and closing said grippers; and drive means for driving said print head, said printing bed, and said gripper carriage in timed relation to one another;

said gripper control means comprising for each repsective gripper assembly:

means biasing the grippers toward the closed position;

an actuating means for opening said grippers, said actuating means being movable between a first position in which said grippers are closed and a second position in which said grippers are open;

a cam follower disposed on said actuating means;

a ramp supported on said frame to engage said cam follower and cam said actuating means from said first position to said second position as said carriage moves forward and approaches said stop, said ramp being operative to maintain said actuating means in said second position when said carriage engages said stop; and ramp displacement means for displacing said ramp after said carriage reaches said stop, thereby disengaging said ramp from said cam follower to allow said actuating means to shift from said second position to said first position, thus permitting said grippers to close;

said drive means being operative to:

drive said gripper carriage to said forward position into engagement with said stop so that said grippers close on a sheet of stock at the input station; displace said temporary stop to permit said sheet to be removed from said input station; drive said carriage rearwardly to position said sheet of stock on said printing bed, while simultaneously raising said printing bed from said lower position to said upper position in an arcuate path, with the speeds of said carriage and said bed being related such that the travel of said bed relative to said sheet is substantially entirely vertical as said carriage approaches its rear position; effect printing on said sheet; open said forward grippers to release said sheet; shift said printing bed from its upper to its lower position while holding the sheet thereon to remove said sheet from said forward grippers; and drive said carriage forward to transport said forward grippers to the input station to pick up another sheet of stock, and transport said rear grippers to said printing bed to pick up the sheet previously printed.

* * * * *

UNITED STATES PATENT AND TRADEMARK OFFICE

CERTIFICATE OF CORRECTION

PATENT NO. : 4,879,948

DATED : November 14, 1989

INVENTOR(S) : Henry J. Bubley

It is certified that error appears in the above-identified patent and that said Letters Patent is hereby corrected as shown below:

Column 3, Line 15, after "which", delete --:--. (colon)

Column 3, Line 25, change "elevation" to --elevational--.

Column 3, Line 42, change "elevation" to --elevational--.

Column 5, Line 3, after "so that" (first occurrence), delete --so that--.

Column 7, Line 22, change "is" to --it--.

Column 7, Line 25, change "20" to --120--.

Column 8, Line 42, change "a" to --an--.

Column 9, Line 2, change "positon" to --position--.

Column 10, Line 51, after "gripper", insert --means--.

Column 11, Line 34-35, change "repsective" to --respective--.

Signed and Sealed this

Eighteenth Day of December, 1990

*Attest:*

HARRY F. MANBECK, JR.

*Attesting Officer*

*Commissioner of Patents and Trademarks*